US007501082B2

(12) United States Patent
Mencke

(10) Patent No.: US 7,501,082 B2
(45) Date of Patent: Mar. 10, 2009

(54) OVEN FOR DRAWING FIBRES AT ELEVATED TEMPERATURE

(75) Inventor: Jacobus Johannes Mencke, Maastricht (NL)

(73) Assignee: DSM IP Assets B.V., Heerlen (NL)

( * ) Notice: Subject to any disclaimer, the term of this patent is extended or adjusted under 35 U.S.C. 154(b) by 589 days.

(21) Appl. No.: 10/398,565

(22) PCT Filed: Sep. 27, 2001

(86) PCT No.: PCT/NL01/00712

§ 371 (c)(1),
(2), (4) Date: Apr. 8, 2003

(87) PCT Pub. No.: WO02/34980

PCT Pub. Date: May 2, 2002

(65) Prior Publication Data

US 2004/0040176 A1 Mar. 4, 2004

(30) Foreign Application Priority Data

Oct. 9, 2000 (NL) ..... 1016356

(51) Int. Cl.
*D02J 1/22* (2006.01)

(52) U.S. Cl. ..... 264/40.1; 28/245; 34/79; 34/459; 34/480; 34/561; 34/657; 264/290.5; 425/135; 425/210; 425/363

(58) Field of Classification Search ..... 264/210.8, 264/290.5, 40.1; 425/73, 210, 363, 404, 425/445, 135; 28/240, 245; 34/79, 444, 34/657, 459, 480, 561; 126/273.5
See application file for complete search history.

(56) References Cited

U.S. PATENT DOCUMENTS 4,521,931 A * 6/1985 Katsuki et al. ..... 8/149.2
4,646,391 A * 3/1987 Wolf ..... 19/258
5,262,110 A * 11/1993 Spaller et al. ..... 264/207

FOREIGN PATENT DOCUMENTS

EP 064 167 A1 11/1982

OTHER PUBLICATIONS

Forster, H. "Organic Vapors in Air and Nitrogen—Disposal or Recovery of Potentially Valuable Recyclables"?, Erdol Erdgas Kohle 114, No. 4, Apr. 1995 (pp. 211-214; pp. 1-11 of English-language translation).*

"Dynee-Polyethylenefaser fur technische Einsatzgebiet", Chemiefasern Textilindustrie, vol. 35, No. 1, Jan. 1985, pp. 33-34.

Patent Abstracts of Japan, vol. 017, No. 693, Dec. 17, 1993, English abstract of JP 05 230732.

Patent Abstracts of Japan, vol. 013, No. 589, Dec. 25, 1989, English abstract of JP 01 246437.

* cited by examiner

*Primary Examiner*—Leo B Tentoni
(74) *Attorney, Agent, or Firm*—Nixon & Vanderhye P.C.

(57) ABSTRACT

The invention relates to an oven for drawing fibers at elevated temperature, which oven is on two sides opposite one another provided with guide rolls dictating a zigzag up-and-down drawing trajectory for the fiber in the oven. In the oven according to the invention the drawing trajectory is at least 20 meters long and the rolls are driven. The invention also relates to a process for drawing fibers using the oven according to the invention, in particular to a process for producing highly oriented polyethylene fibers.

16 Claims, No Drawings

OVEN FOR DRAWING FIBRES AT ELEVATED TEMPERATURE

CROSS REFERENCE TO RELATED APPLICATION

This application is the National Phase of International Application PCT/NL01/00712 filed Sep. 27, 2001 which designated the U.S., and was published in English.

The invention relates to an oven for drawing fibres at elevated temperature, which oven is on two sides opposite one another provided with guide rolls dictating a zigzag up-and-down trajectory for the fibre in the oven. The invention also relates to a process for drawing fibres using the oven according to the invention, in particular to a process for producing highly oriented polyethylene fibres.

An oven as described above is known from Chemiefasern Textilindustrie, January 1985. This schematically describes that a polyethylene gel fibre is drawn in an oven having two guide rolls on two sides opposite one another, which pass the gel fibre zigzag up and down through the oven. The aim of the zigzag passage through the oven is to obtain a long drawing trajectory within a restricted space. Another example of such an oven is described in Example 4 of EP-A-205,960. This describes a "multi-pass" oven with 3 traverses and a total drawing trajectory of 12 metres. At the beginning and the end of the drawing trajectory are drawing devices which draw the fibre to a particular draw ratio, determined by the ratio of the speeds of the drawing devices at the end and the beginning. Drawing devices are capable of imposing a velocity and a stress on the fibre because there is sufficient friction resistance between the fibre and the device as a result of several wraps.

The drawback of the known oven is that this one is very unattractive for use on a commercially attractive industrial scale. It is not possible to give a fibre a high draw ratio and obtain a highly oriented fibre in a single step with an acceptable production capacity. In EP-A-205,960 several drawing steps are to this end carried out successively at an increasing drawing stress and drawing temperature and a decreasing drawing rate. This is difficult to implement technically and economically unattractive on an industrial scale. The forces that the fibres exert on the rolls during the drawing at high temperatures cause wear of the bearings and unobserved drifting of the friction of the bearings. Problems of friction of bearings lead to unobserved changes in drawing conditions, to the tearing of yarn and loss of production capacity. The known ovens are also particularly unsuitable for producing fibres having a very low creep rate with an acceptable capacity. Another drawback is that, in production on an industrial scale, the guide rolls have dimensions such that the mass inertia of the guide rolls makes it necessary to start up the drawing process slowly, with a resultant loss of fibres and capacity.

The aim of the invention is to provide a drawing oven that does not possess said drawbacks, or possesses them to a lesser extent.

This aim is achieved according to the invention because the drawing trajectory is at least 20 metres long and the guide rolls are driven.

It has been found that with the oven according to the invention it is possible to impose a high draw ratio in a single drawing step with a high production capacity. It is possible to produce fibres with a very low creep rate. The drawing process is stable, less titre spread occurs and there is no loss as a result of drift in the friction of bearings. The drawing process can be started up quickly, with minimum loss in the form off-spec material.

The guide rolls are preferably driven by electromotors. Preferably use is then made of a control system with which the peripheral velocity of each of the guide rolls can be set and controlled separately. The speed at which each of the guide rolls is driven is chosen so that no slip occurs between the fibre and the guide roll. In a preferred embodiment of the invention the drawing oven is provided with devices for measuring the power uptake of the driving mechanism of the guide rolls. The advantage of this is that, on the basis of the power consumption, any drift in the friction of the bearings can be observed in due time, before the yarn unexpectedly tears. Preferably the speed of each of the guide rolls is chosen so that the power uptake of the guide rolls in the drawing process is as low as possible. This power uptake can be determined for each roll separately by comparing the power uptake during drawing with the power uptake at the same oven settings without the presence of fibres. The advantage of this is that slip between the fibre and the guide rolls is prevented and that the drawing process is more stable.

Preferably the guide rolls are cylindrical, with a length of at least 20 cm. The advantage of this is that several fibres can be drawn next to one another. The length is preferably at least 50 cm, more preferably even more than 1 metre. It has been found that when a large number of fibres are simultaneously drawn on such long guide rolls the problem arises that the guide rolls bend under the drawing stress, causing the fibres to move from their position. With bearings on one side, the fibres then run off the roll. With bearings on two sides, the fibres run to the middle of the roll. Preferably the bending of the roll during drawing is less than 0.1%. 'Bending of the roll' is here understood to be the maximum deviation of the roll's body axis under the influence of the yarn stress relative to the normal, unstressed condition divided by the roll length (times 100%). Preferably the radius of the guide rolls is at least 2 cm and more preferably at least 5 cm. The bending of the roll will consequently be less, and the homogeneity of the drawing will be better, especially in the case of thick filaments or multifilament yarns.

Preferably the length of the drawing trajectory in the oven according to the invention is at least 50 m. More preferably the length of the drawing trajectory is at least 75 m, more preferably at least 100 metres and most preferably more than 125 m. One of the advantages is that a higher draw ratio can be imposed in a single step with an acceptable capacity. The number of driven guide rolls is then chosen to keep the oven dimensions within acceptable limits and to prevent the risk of the fibres sagging between the guide rolls. Preferably the distance between the guide rolls is more than 2 m, preferably more than 5 m, but less than approximately 20 metres, more preferably less than 15 metres and even more preferably less than 10 metres.

The heating in the oven is preferably effected by heated gas. Preferably the oven is provided with devices for realising a flow of heated gas. Preferably the direction of the flow of gas is at an angle, preferably virtually perpendicular, to the main transport direction of the fibres between the guide rolls. The advantage of this is that the distribution of temperature in the oven is better defined and that substances released from the fibre are discharged. In another embodiment the oven is provided with devices for heating or cooling the gas stream to create a temperature gradient in a direction perpendicular to the transport direction, as a result of which the fibre will in particular have a higher or lower temperature at the end of the trajectory than at the beginning. These devices are for example heat exchangers or devices for blowing in gas.

In yet another embodiment the oven has two or more devices for creating a flow of gas in a direction substantially perpendicular to the transport direction of the fibre, it then being possible to set the temperature of the gas flow separately in each of the devices. These devices are preferably next to one another in the transport direction of the fibres. A temperature gradient can thus be created in the transport direction of the fibres. These devices consist of for example a gas heating and a blow-in device.

In a particular embodiment of the oven according to the invention the oven is provided with a gas purification installation for purifying the gas stream. This embodiment is particularly advantageous for drawing fibres that still contain volatile components which are released during drawing at elevated temperature. That makes the oven suitable as a drying oven.

Preferably the oven then contains devices, on the side opposite that on which the gas flow is created, for leading the gas stream to the gas purification installation.

The invention also relates to a process for drawing fibres in which use is made of an oven according to the invention described above and the fibres obtainable therewith. The invention also relates to a process for drying and simultaneously drawing a fibre containing solvent in which use is made of an oven according to the invention. Preferably the solvent removed from the fibre is recovered in the gas purification installation. In the latter process, preferably a temperature gradient has been created in the oven in the direction perpendicular to the transport direction of the fibre, the temperature being higher at the end of the drawing trajectory than at the beginning.

In particular, the invention relates to a process for producing a highly oriented polyethylene fibre characterised in that a lowly oriented polyethylene precursor fibre is drawn in a single step at a temperature of between 135 and 160° C., at a draw ratio of at least 2.5, to form a highly oriented polyethylene fibre having a modulus of elasticity of at least 1000 g/den and a strength of at least 30 g/den.

The advantage of said process over the process described in EP-A-205,960 is that the process is less laborious and economically more attractive, especially when used on a large industrial scale. The draw ratio is preferably at least 3, more preferably at least 3.5, even more preferably at least 4 and most preferably at least 4.5.

'Lowly oriented' is here understood to be having a tensile modulus of less than 500 g/den and a tensile strength of less than 20 g/den. Preferably the lowly oriented precursor fibre in the process according to the invention has a tensile modulus of between 150 and 500 g/den and a tensile strength of between 5 g/den and 20 g/den. A temperature gradient can be applied in drawing the precursor fibre. In practice, the drawing temperature will preferably be virtually the same in all parts of the oven because then a more stable process will be obtained, that is, there will be less risk of the yarn tearing.

Preferably the polyethylene precursor fibre is drawn in the oven according to the invention as described above. One of the advantages of this is that it is then possible to produce highly oriented polyolefine fibres in a single drawing step on an industrial scale with a good productivity starting from a lowly oriented precursor fibre. Good creep properties can be obtained. 'Good creep properties' are understood to be a plateau creep rate (at 71° C. and 270 MPa) of less than approximately 0.4%/h, preferably less than 0.2%/h, and most preferably even less than 0.1%/h. Other preferred embodiments and advantages have been described above in the description of the drawing oven.

The tensile strength (strength) and the tensile modulus (modulus) have been defined and are determined as described in ASTM D885M, using a clamping length of the fibre of 500 mm, a crosshead speed of 50%/min. and Instron 2714 clamps. The fibre is first twined at 31 rpm. The modulus is inferred from the measured stress-strain curve as the gradient between 0.3 and 1% elongation. The modulus and strength are calculated by dividing the measured tensile forces by the titre, determined by weighing 10 metres of fibre.

In a particularly preferred embodiment of the process the precursor fibre is produced by drying and simultaneously drawing a polyethylene gel fibre containing solvent. In this process the temperature of the fibre is in all parts of the fibre's trajectory through the oven preferably more than 10° C. lower than the melting temperature of the fibre to be formed. This presents the advantage that there is less risk of the yarn tearing and more effective chain orientation takes place. 'Melting temperature' is understood to be the peak melting temperature measured in a DSC at a heating rate of 10° C./min in an unconstrained sample.

The invention claimed is:

1. Oven for drawing fibre at elevated temperature, comprising:

guide rolls on two sides of the oven opposite one another, the guide rolls dictating a zigzag up-and-down drawing trajectory for the fibre in the oven which is at least 20 meters long, driving mechanisms associated operatively with each of the guide rolls for driving each of the guide rolls at a selected peripheral velocity, a control system operatively connected to the driving mechanisms for separately setting and controlling the selected peripheral velocity of each of the guide rolls so as to draw the fibre as it traverses the drawing trajectory in the oven, and wherein the control system includes devices for determining the power uptake of the driving mechanisms so that each of the guide rolls may be driven at a selected peripheral velocity so as to prevent slip between the fibre and the guide rolls.

2. Oven according to claim 1, wherein the guide rolls are cylindrical and have a length of at least 20 cm, several fibres being able to be passed over the guide rolls simultaneously next to one another.

3. Oven according to claim 2, wherein the bending of the roll during the drawing is less than 0.1%.

4. Oven according to claim 1, wherein the drawing trajectory is at least 50 m and the oven contains at least 4 guide rolls.

5. Oven according to claim 1, further comprising devices for creating a gas flow in a direction substantially perpendicular to the transport direction of the fibres between the guide rolls.

6. Oven according to claim 1, further comprising devices for heating or cooling the gas stream to create a temperature gradient in a direction perpendicular to the transport direction.

7. Oven according to claim 1, further comprising a gas purification installation.

8. Process for drawing a fibre containing solvent, which comprises:

passing the fiber at elevated temperature inside an oven via driven guide rollers on two opposite sides thereof, said driven guide rollers dictating a zigzag up-and-down trajectory which is at least 20 meters long, driving each of the guide rollers at a selected peripheral velocity by driving mechanisms, controlling the drive mechanisms by a controller so as to separately set and control the selected peripheral velocity of each of the driven guide rolls to draw the fibre as it traverses the drawing trajectory in the oven, wherein the step of controlling the drive mechanisms comprises determining the power uptake of the driving mechanisms to allow each of the guide rolls to be separately controllably driven by the controller at the selected peripheral velocity which prevents slip between the guide roll and the fiber, and recovering the solvent being removed from the fiber, in a gas purification installation operably connected to said oven.

9. Process according to claim 8, further comprising creating a temperature gradient in the oven in the direction perpendicular to the transport direction of the fibre, wherein the temperature is higher at the end of the drawing trajectory.

10. Process for producing a highly oriented polyethylene fibre, comprising drawing, in a single step, a lowly oriented polyethylene precursor fibre in an oven as set forth in any one of claims 1, 2, 3, 4, 5, 6 or 7, at a drawing temperature of between 135 and 160° C. and a draw ratio of at least 2.5 to form a highly oriented polyethylene fibre having a tensile modulus of at least 1000 g/den and a strength of at least 30 g/den.

11. Process according to claim 10, wherein the precursor fibre has a tensile modulus of between 150 and 500 g/den and a tensile strength of between 5 g/den and 20 g/den.

12. Process according claim 10, wherein the drawing temperature is virtually the same in all parts of the oven.

13. Process according to claim 10, wherein the precursor fibre has been made by drying and simultaneously drawing in an oven which on two sides opposite one another, is provided with guide rolls dictating a zigzag up- and- down drawing trajectory for the fibre in the oven, wherein the drawing trajectory is at least 20metres long and the guide rolls are driven by driving mechanisms, and wherein the fiber is a polyethylene gel fibre containing solvent, said oven further comprising a gas purification installation, removing the solvent and recovering the solvent in the gas purification installation.

14. Process according to claim 13, wherein the temperature of the fibre is in all parts of the fibres trajectory through the oven more than 10°lower than the melting temperature of the lowly oriented precursor fibre to be formed.

15. Process according to claim 14 wherein the temperature of the gas is in all parts of the oven more than 10°lower than the melting temperature of the fibre to be formed.

16. Oven according to claim 1, wherein the driving mechanisms include electromotors.

* * * * *